US009670629B2

(12) United States Patent
Buschmann et al.

(10) Patent No.: US 9,670,629 B2
(45) Date of Patent: Jun. 6, 2017

(54) PAVING SCREED FOR A ROAD FINISHER

(71) Applicant: JOSEPH VOEGELE AG, Ludwigshafen/Rhein (DE)

(72) Inventors: Martin Buschmann, Neustadt (DE); Ralf Weiser, Ladenburg (DE)

(73) Assignee: JOSEPH VOEGELE AG (DE)

( * ) Notice: Subject to any disclaimer, the term of this patent is extended or adjusted under 35 U.S.C. 154(b) by 0 days.

(21) Appl. No.: 15/241,261

(22) Filed: Aug. 19, 2016

(65) Prior Publication Data

US 2016/0356000 A1 Dec. 8, 2016

Related U.S. Application Data

(63) Continuation of application No. 14/297,849, filed on Jun. 6, 2014, now Pat. No. 9,447,552.

(30) Foreign Application Priority Data

Jun. 11, 2013 (EP) ..... 13002981

(51) Int. Cl.
*E01C 19/00* (2006.01)
*E01C 19/42* (2006.01)
*E01C 19/48* (2006.01)

(52) U.S. Cl.
CPC ..... *E01C 19/42* (2013.01); *E01C 19/002* (2013.01); *E01C 19/48* (2013.01); *E01C 2301/16* (2013.01)

(58) Field of Classification Search
CPC ..... E01C 19/42; E01C 19/48; E01C 2301/16
USPC ..... 404/84.05, 84.1, 84.5, 118
See application file for complete search history.

(56) References Cited

U.S. PATENT DOCUMENTS

| | | | |
|---|---|---|---|
| 4,682,908 | A | 7/1987 | Domenighetti |
| 5,362,176 | A | 11/1994 | Sovik |
| 7,121,763 | B1 | 10/2006 | Young et al. |
| 7,484,911 | B2 | 2/2009 | Frelich |
| 7,651,295 | B2 | 1/2010 | Eppes et al. |

(Continued)

FOREIGN PATENT DOCUMENTS

| | | | |
|---|---|---|---|
| EP | 0879918 | A1 | 11/1998 |
| EP | 2233641 | A2 | 9/2010 |

(Continued)

OTHER PUBLICATIONS

European Communication Dated Aug. 31, 2015, with Attached Aug. 25, 2015, Third Party Observation, Application No. 13002981.2-1604 / 2813619, Applicant Joseph Voegele AG, 5 Pages.

(Continued)

*Primary Examiner* — Raymond W Addie
(74) *Attorney, Agent, or Firm* — Brooks Kushman P.C.

(57) ABSTRACT

A paving screed to be employed on a road finisher comprises a base screed, the operating width of which may be modified by protractable extending units and/or separate removable bolt-on extensions. The paving screed also includes a plurality of side plates, each being mountable on an outer end of the base screed or an extending unit or a bolt-on extension and which delimit the operating width. At least one reference element for determining the operating width is provided on one of the side plates, and that the at least one reference element is detectable by one or more sensor units when the side plates are each mounted on the outer ends of the base screed, an extending unit or a bolt-on extension.

21 Claims, 8 Drawing Sheets

(56) References Cited

U.S. PATENT DOCUMENTS

| | | | | |
|---|---|---|---|---|
| 8,061,931 | B2 * | 11/2011 | Musil | E01C 19/174 404/101 |
| 9,200,415 | B2 * | 12/2015 | Graham | E01C 19/48 |
| 9,447,552 | B2 * | 9/2016 | Buschmann | E01C 19/42 |
| 2006/0198700 | A1 * | 9/2006 | Maier | E01C 19/006 404/84.1 |
| 2007/0150148 | A1 | 6/2007 | Rasmussen | |
| 2010/0178107 | A1 * | 7/2010 | Braddy | E01C 19/182 404/75 |
| 2010/0256878 | A1 | 10/2010 | Zegowitz | |
| 2010/0284742 | A1 * | 11/2010 | Christ | E01C 19/48 404/118 |
| 2011/0085859 | A1 * | 4/2011 | Yost | E01C 19/004 404/84.5 |
| 2012/0288328 | A1 * | 11/2012 | Minich | E01C 19/1063 404/72 |
| 2014/0119826 | A1 * | 5/2014 | Graham | E01C 19/42 404/75 |
| 2014/0186115 | A1 * | 7/2014 | Graham | E01C 19/4873 404/75 |

FOREIGN PATENT DOCUMENTS

| | | | |
|---|---|---|---|
| EP | 2239374 | A1 | 10/2010 |
| EP | 2261421 | A1 | 12/2010 |
| EP | 2503283 | A1 | 9/2012 |
| JP | S59-021835 | A | 3/1984 |
| JP | H04-105108 | U | 9/1992 |
| JP | 2006161421 | A | 6/2006 |
| JP | 2007303222 | A | 11/2007 |
| JP | 2012241468 | A | 12/2012 |
| WO | 2010003636 | A1 | 1/2010 |

OTHER PUBLICATIONS

Extended European Search Report Dated Nov. 28, 2013, Application No. 13002981.2-1604, Applicant Joseph Voegele AG, 6 Pages.

Japanese Office action Dated Apr. 28, 2015, Application No. 2014-063977, 5 Pages.

* cited by examiner

PAVING SCREED FOR A ROAD FINISHER

CROSS-REFERENCE TO RELATED APPLICATIONS

This application is a continuation of U.S. application Ser. No. 14/297,849 filed Jun. 6, 2014, which claims foreign priority benefits under 35 U.S.C. §119(a)-(d) to European patent application number EP 13 002 981.2, filed Jun. 11, 2013, each of which is incorporated herein by reference in its entirety.

TECHNICAL FIELD

The present disclosure relates to a paving screed to be employed on a road finisher.

BACKGROUND

Such paving screeds are known in practice. They are used in road construction to smooth and compact layers of pavement, for example made of asphalt. Paving screeds of various designs are used, for example, fixed-width screeds whose width is invariable, fixed-width screeds whose width may be modified by means of separate add-on components, as well as extendable screeds whose width may be variably modified with the aid of extending units. Here too, separate bolt-on extensions may also be attached. So-called side plates are attached to each of the outer ends of the screed, which prevent material in front of and under the screed from escaping to the sides.

The width of the entire screed, also referred to as operating width, is an important parameter, since it affects important regulating variables of the road finisher, for example, the material needed in front of the screed and, therefore, the output or the speed of the material delivery systems of the road finisher. Due to the increasing automation of the operation of road finishers, it is advantageous to in some way provide the various control systems with the width of the paving screed.

In conventional screeds this still occurs frequently by manual input. In extendable screeds, measuring systems are used which identify the sliding path of the screed extensions. In the simplest case, this involves scales with pointers. Once read, the value must be added to the width of the base screed and input into the control system. Other measuring systems identify the sliding path and provide this directly to the machine control system. The addition of the respective sliding path and the width of the base screed is then handled by the control system. However, such systems do not take into account potentially separately mounted bolt-on extensions such that when the latter are used, another input by the operator must be made.

Applicant's European patent application EP 2 239 374 A1 discloses a road finisher which may be upgraded with multiple auxiliary components. Said auxiliary components are equipped with wirelessly readable identification devices which can be read out by a reading device on the road finisher. Auxiliary components mentioned are, among others, extending units of extendable paving screeds as well as fixed bolt-on extensions. Also provided is a measurement of the distance between the reading device on the road finisher and the identification means mounted on the extending units or bolt-on extensions. It has turned out that this system has optimization potential. For one, both the extending units of extending screeds as well as all separate bolt-on extensions must be provided with identification means. For another, the plurality of identification means gives rise to a significant fault potential. For example, it is necessary in very long screeds which have multiple add-on components to process a large number of signals, which increases the susceptibility to failures. Moreover, it may happen that the signal of the outermost add-on component cannot be received by the reading unit due to limited range or to distortions. If the latter then receives a signal of an add-on component situated further inward, the system, unbeknownst to the operator, is then provided with a false operating screed width. In addition, problems may also arise in conjunction with asymmetrically widened screeds, since it then becomes difficult to determine which signal from an add-on component indicates the correct screed width.

SUMMARY

An object of the present disclosure is to provide a paving screed for a road finisher of which the design is improved in the simplest possible way, in order to enable an operation that is user-friendly and least susceptible to failure.

The disclosure provides for at least one reference element for determining the operating width to be mounted on at least one of a plurality of side plates. In this configuration the at least one reference element is detectable by means of sensor units when the side plates are mounted on the respective outer ends of the base screed or of the extending units or of the bolt-on extensions. As a result, only one reference element per screed section is required. By attaching the reference element to the respective side plate, it is ensured that the latter is always attached to the outermost point of the paving screed. In the event the reference element is located out of range of the sensor units or the signal path is disrupted in some other way, the sensor unit will receive no signal. In this way a disruption of the operation would be noticed immediately. Preferably, in the event that no signal is received, the operator may be shown an error signal, for example, a visual, an acoustic or a tactile signal. Conceivable in such case are, for example, warning sounds from existing signal generators or signal generators provided for specifically this purpose, as well as special warning lights for just this purpose or else messages on a display, such as for example, an alphanumeric display, a dot-matrix display or else a liquid crystal or LED display.

The sensor unit and the reference element may be based on various measuring methods, for example, ultrasound, radar, microwave, radio signals or optical measuring methods such as, for example, laser. Accordingly, a suitable or several suitable sensors may be provided in the sensor unit as well as suitable reference elements. Thus, at least one sensor for detecting the aforementioned signals can be provided in the sensor unit. Various types of reflectors or transceiver units on the reference element are conceivable. Additionally, the sensor unit or the sensor units may contain at least one transmitting device which is configured to send a measuring signal of the aforementioned kind. The measuring signals may simply be reflected or else received by suitable transceiver units and, sent back, optionally supplemented with auxiliary information such as, for example, time stamp, position or identification information.

It is conceivable to provide at least one sensor on the base screed which is configured to measure the distances to the at least one reference element. In this arrangement, a sensor unit may be provided, for example, which detects all reference elements on all side plates and measures the distance to them. In a further example, a sensor unit may be provided for each screed section which is configured to measure the distance to an associated reference element on an associated side plate. In paving screeds that have a left and right screed section, two sensor units would be provided in such case. A first, right sensor unit would measure the distance to a reference element on a right side plate, a second left sensor unit would in such case measure the distance to a reference element on the left side plate. For cases in which the respective sensor units are attached to the left and right side of the base screed, it would be possible to upgrade a control system of a road finisher in which heretofore only the extending units were taken into account, without having to modify the control.

In a further advantageous variant, a sensor unit is provided on at least one of the side plates which is configured to measure the distance to the at least one reference element on another of the side plates. This makes it possible to minimize the number of both the sensor units as well as the reference elements. In embodiments having a left and a right side plate, only one sensor unit and one reference element are necessary. In addition, the entire screed width is immediately detected without having to add various lengths.

It is conceivable that the reference elements are attached directly to the side plates. These may be, for example, adhesive or screw-on elements that are attached on a side of the side plate which faces the respective sensor unit. Structures integrated into the respective side plates are also conceivable.

In a further variant, the reference elements are attached indirectly to the side plates by adapters. In this way, the alignment with the respective sensor unit may potentially be improved, or adjusted during operation. In systems which react sensitively to objects that are placed in the signal path, the signal path may also be shaped in such a way that as few objects as possible are situated therein.

It is advantageous if the respective reference element is aligned with an associated sensor unit if the respective side plate is mounted on the respective outer ends of the base screed or the extending unit or the bolt-on extensions. This may facilitate the mounting of the side plate and the reference elements. In addition, it is conceivable that the side plates and/or the adapters may only be affixed in one correctly aligned configuration. This avoids errors during assembly.

It is conceivable that the sensor units may be configured for determining the operating width by triangulation. This permits a flexible arrangement of the sensor units. Moreover, disruptive objects may be circumvented in this way.

Preferably, the paving screed according to the disclosure is employed on a road finisher.

It is particularly advantageous if the road finisher having the paving screed according to the disclosure includes a control system which is configured to utilize the ascertained operating width as an input variable. Using the operating width, it is possible to set various regulating variables of the road finisher, for example, the speed of various conveying systems.

It is also conceivable that at least one of the sensor units for determining the operating width is provided on the road finisher. This may be very useful in the case of very large paving widths, since potentially more exposed mounting positions exist on the road finisher than on the paving screed itself. In addition, the expenditure involved in connecting a sensor unit to the control system of the road finisher would be reduced, since for the sensor unit at least there is no coupling necessary between road finisher and screed.

The present disclosure also relates to a method for determining the operating width of a paving screed which may be employed on a road finisher. The paving screed comprises a base screed, the operating width of which may be modified by extending units and/or separate bolt-on extensions, multiple side plates which are mounted respectively on the outer ends of the base screed or of the extending units or of the bolt-on extensions and which delimit the operating width. The method is characterized in that reference elements are used in the area of the side plates for determining the operating width.

It is conceivable that the distance to at least one reference element attached to one of the side plates, respectively, is measured by at least one sensor unit associated with the respective side plate. If, for example, a base screed is provided with a right and a left extending unit, in which a side plate is attached at the outer end of each of the left and the right extending units, a right and a left sensor unit would then be used to measure the respective distances to the at least one reference element which is attached to each of the right and left side plates. In this case, the left and right sensor unit may each be attached to the left and the right end respectively of the base screed. However, it is equally conceivable for both sensor units to be mounted centrally between the side plates, on the screed or also on a road finisher which pulls the screed. It is likewise conceivable to combine the two aforementioned sensor units into one sensor unit. In this variant, one sensor unit would be positioned between the side plates or reference elements and would measure the distances to the reference elements in two directions. In such case, the two measured values would merely have to be added together in order to obtain the operating width of the screed. The width of the base screed would not need to be known by the system. Such a sensor unit would merely have to be positioned between the reference elements, i.e., a central arrangement is necessarily required. Instead, in this arrangement it must only be ensured that the sensor unit lies along a straight line connecting two reference elements, and that the ranges of the sensor unit in both directions is not exceeded.

It is equally conceivable that the distance to a reference element attached to a first side plate is measured by a sensor unit attached to a second of the side plates. In such case, a paving screed having two side plates mounted opposite one another would require merely one sensor unit and one reference element. Moreover, the measured value, optionally taking into account the dimensions of each sensor unit and of each reference element, would correspond directly to the operating width of the screed. Accordingly, this configuration would allow for a particular simple design and a simple further processing of the measured value.

In a further advantageous variant the distance between the reference elements may be measured by means of triangulation. Several sensor units are necessary in this case. However, there are advantages such as, for example, greater latitude in the arrangement of the sensor units. The latter may be distributed at various locations on the screed and the road finisher. A skillful arrangement of the sensor units can also prevent disruption caused by objects in the signal path.

Several advantageous embodiments of the disclosure are described in greater detail below with reference to the drawings.

DETAILED DESCRIPTION

As required, detailed embodiments of the present disclosure are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1A:
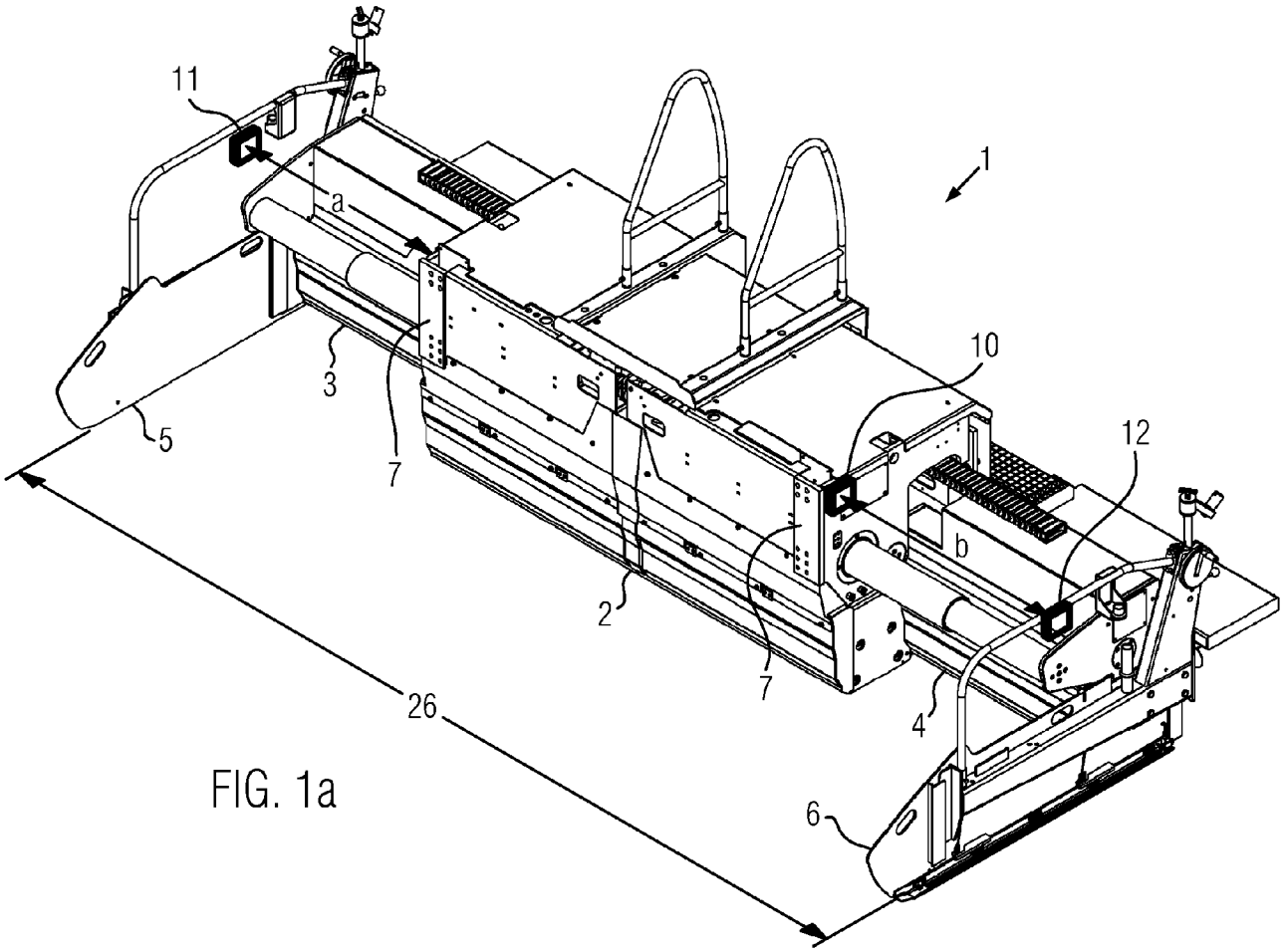
FIG. 1*a* shows a perspective view of a paving screed according to the disclosure with extending units protracted.

FIG. 1*a* shows a paving screed 1. It comprises a base screed 2 which may be widened by first and second extending units 3, 4. Mounted on the outer ends of the first and second extending units 3, 4 are a first and a second side plate 5, 6. They prevent the road construction material from being distributed beyond a desired width. Provided on the base screed 2 are mounting devices 7 with which the paving screed 1 may be mounted on a road finisher 8 (see FIG. 10). According to a first embodiment, the paving screed 1 includes a first sensor unit 9 as well as a second sensor unit 10 (see FIG. 3). In this embodiment they are mounted on the base screed 2. The first sensor unit 9 measures a distance a to a first reference element 11, which is affixed to the first side plate 5. The second sensor unit 10 measures a distance b to a second reference element 12, which is affixed to the second side plate 6. The measured distances a and b are then added to the width of the base screed 2, taking into account the overhang of the sensor units 9, 10, by means of which an operating width 26 of the paving screed 1 is obtained.

The mounting positions of the sensor units 910 and the reference elements 11, 12 are by way of example merely schematically indicated. The mounting positions of sensor units 9, 10 may be varied arbitrarily. The reference elements 11, 12 may be affixed at any arbitrary position on the respective side plates 5, 6. When positioning the sensor units 9, 10 and when positioning the reference elements, however, it must be ensured that the signal flow between sensor unit 9, 10 and the associated reference element 11, 12 is not adversely affected. In addition, the screed 1 may include, in addition to the extending units 3, 4 an arbitrary number of rigid bolt-on extensions 13, 14 which are mounted on the extending units. It is equally conceivable that the paving screed 1 includes a fixed base screed 2 with no extending units 3, 4 and may be widened with the aid of rigid bolt-on extensions 13, 14. In any case, both symmetrical as well as asymmetrical screed configurations are conceivable.

Figure 1B:
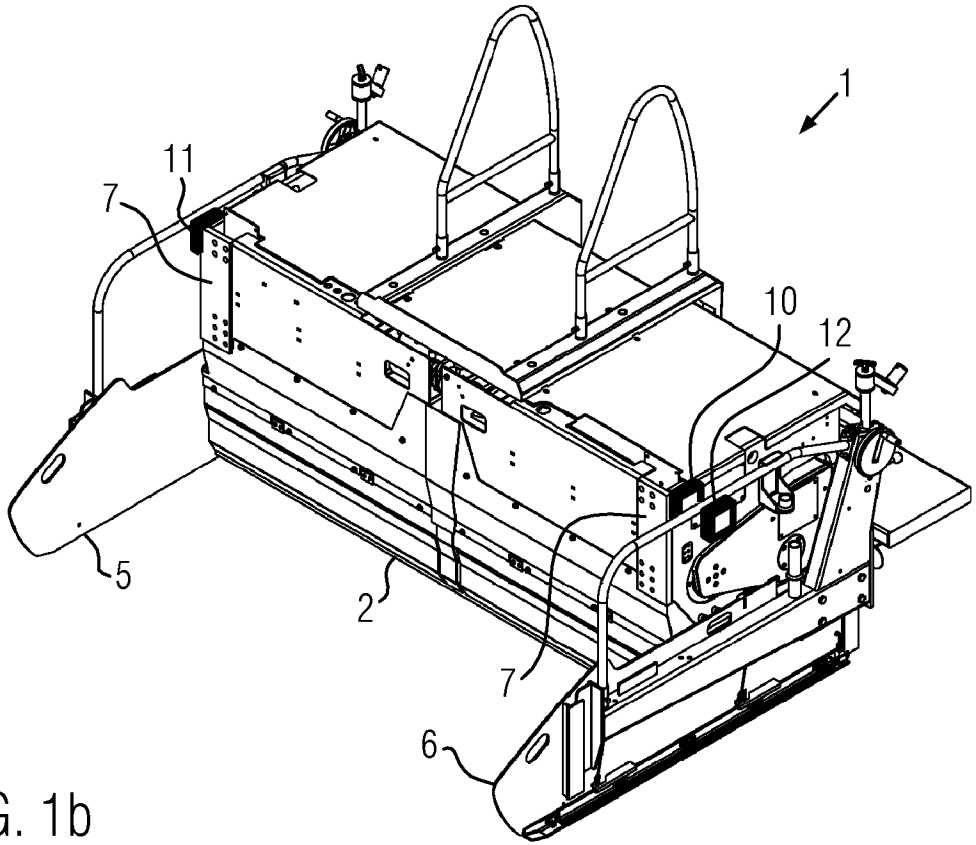
FIG. 1*b* shows the screed from FIG. 1*a* with extending units retracted.

FIG. 1*b* shows a perspective view of the screed from FIG. 1*a*, but in this case the extending units 3, 4 are retracted and therefore not visible.

Figure 2:
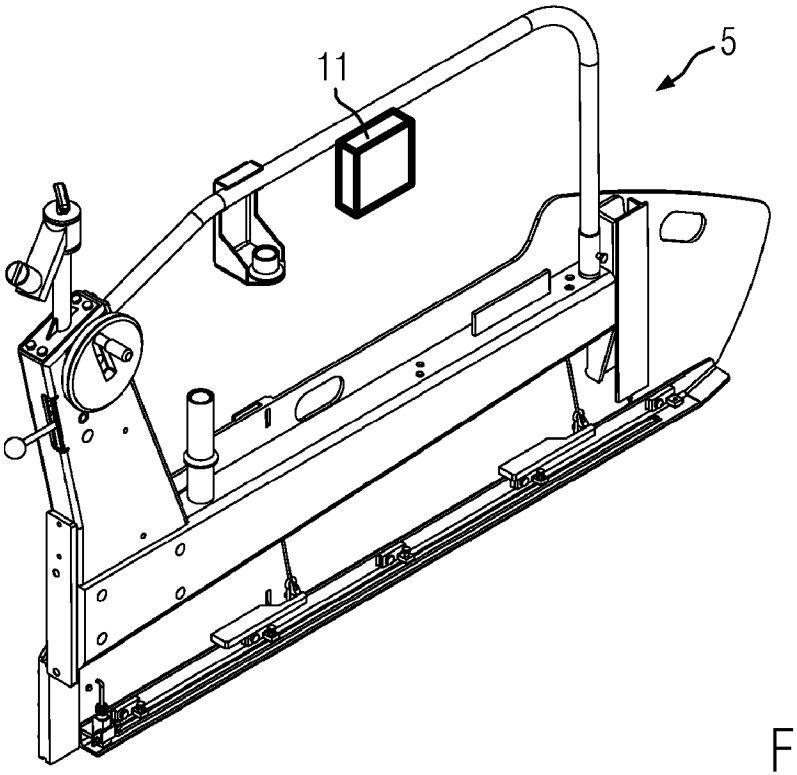
FIG. 2 shows as side plate of the paving screed from FIGS. 1*a* and 1*b;*

FIG. 2 shows by way of example the first side plate 5. Just like the second side plate 6 or else all side plates of the paving screed 1 according to the present disclosure, it is designed to be mountable at each outer end of the paving screed 1.

Figure 3:
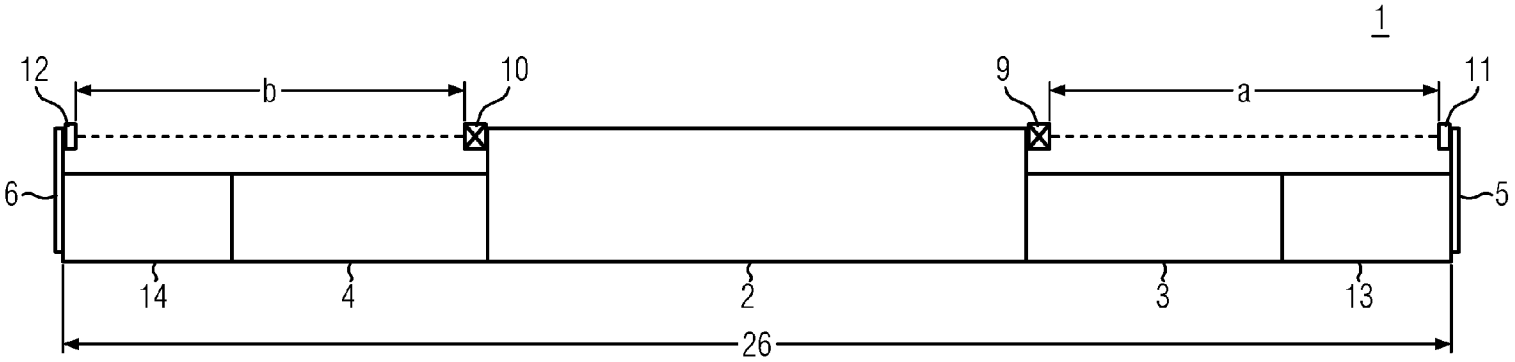
FIG. 3 shows a schematic top view of a paving screed with extending units protracted and mounted bolt-on extensions according to a first embodiment of the disclosure.

FIG. 3 is a schematic top view of the paving screed 1, but widened in this case by first and second bolt-on extensions 13, 14. In this arrangement, the bolt-on extensions 13, 14 are exemplary of all screed configurations which may be implemented with the aid of an arbitrary number of bolt-on extensions 13, 14, which may be arbitrarily dimensioned. As previously mentioned above, the sensor units 9, 10 measure the two distances a and b to the reference elements 11 and 12. In the embodiment shown, the dimensions of the sensor units 9, 10 must also be taken into consideration when summing up the width of the base screed 2. This can be avoided not by mounting the sensor units 9, 10, as shown, on the lateral surfaces of the base screed 2, but rather by attaching them flush with these same lateral surfaces. For example, mounting on an upper surface of the base screed 2 is conceivable. It is equally feasible to integrate the sensor units 9, 10 in the base screed 2 in such a way that they close flush with the lateral surfaces.

Figure 4:
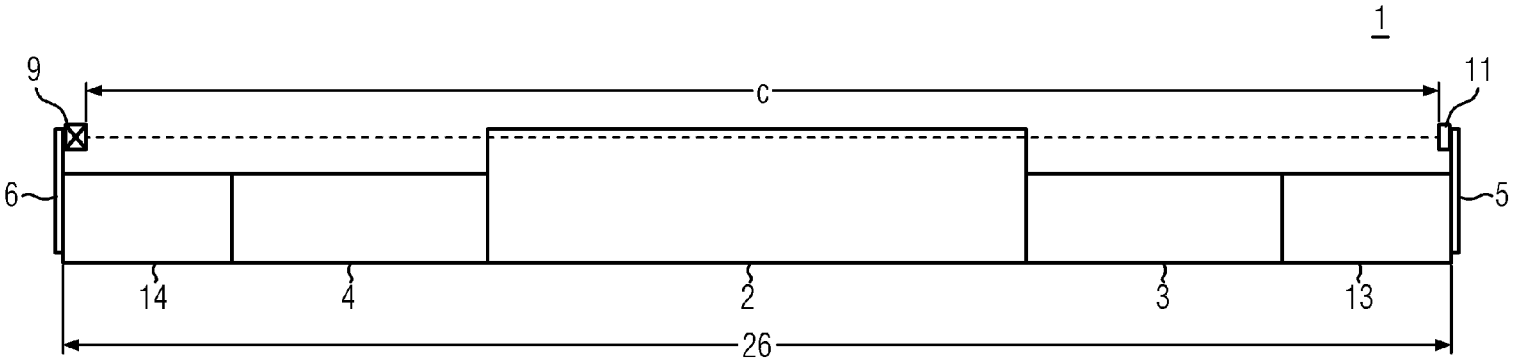
FIG. 4 shows a schematic top view of a paving screed according to a second embodiment of the disclosure.

FIG. 4 shows the paving screed 1 according to a second embodiment of the disclosure. In this embodiment the first sensor unit 9 is mounted on the second side plate 6. The first reference element 11 is still mounted on the first side plate 5. The first sensor unit 9 measures the distance to the first reference element 11. As a result, only the measurements of the first sensor unit 9 and the first reference element 11 need be considered in order to obtain the operating width 26 of the paving screed 1. To avoid this intermediate step, it is conceivable to mount both the first sensor unit 9 as well as the first reference element 11 on the respective side plates 5, 6 in such a way that they lie in the same plane as the side plates 5, 6. This may be achieved, for example, with the aid of adapters 15, 16 (see FIGS. 6 and 7).

Figure 5:
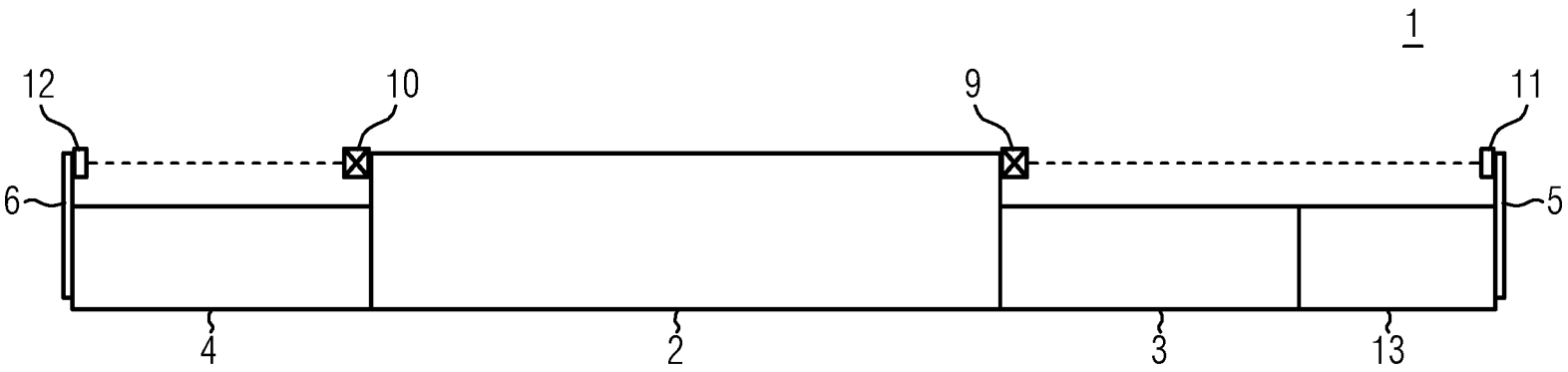
FIG. 5 shows the paving screed from FIG. 3 with two protracted extending units but with only one mounted bolt-on extension, resulting in an asymmetrical configuration of the paving screed.

FIG. 5 shows a variant of the first embodiment of the disclosure. Here only the first bolt-on extension 13 is mounted. This gives rise to an asymmetrical screed configuration. This changes nothing in terms of determining the operating width 26 of the screed 1.

Figure 6:
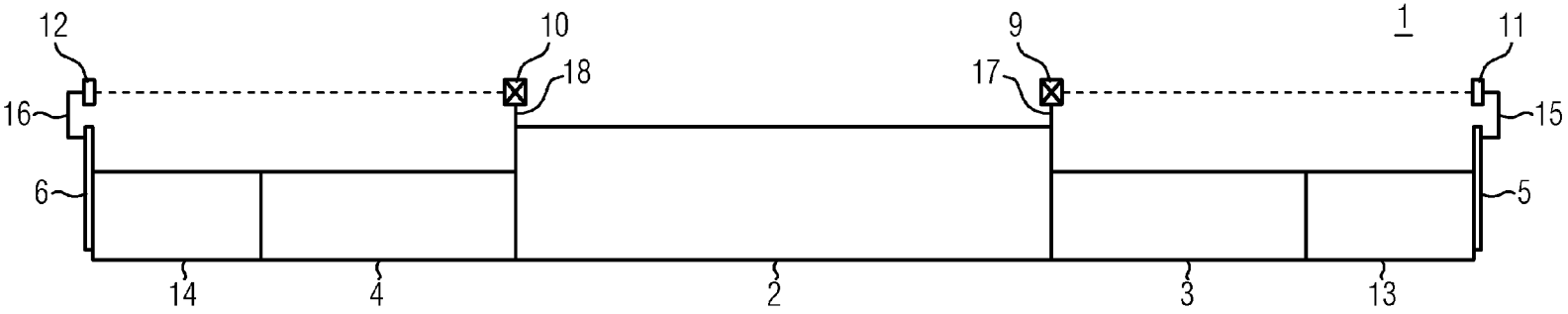
FIG. 6 shows a schematic top view of a paving screed according to a third embodiment of the disclosure, in which the reference elements are mounted on the side plates with the aid of adapters.

FIG. 6 shows a schematic top view of a third embodiment of the paving screed 1. In this configuration the reference elements 11 and 12 were mounted on the first and second side plate 5, 6 with the aid of a first and a second adapter 15, 16. On the one hand, this may offer the advantage that, as previously mentioned above, the reference elements 11, 12 may be arranged in the same plane as the side plates 5, 6, thereby enabling a corrective step to be eliminated when ascertaining the operating width of the paving screed 1. As a further advantage, the reference elements 11, 12 may possibly be better aligned with the respective sensor units 9, 10. The same applies to the mounting of the sensor units 9, 10 with the aid of fastening units 17, 18. Here too, it is possible to select a configuration which improves the alignment of the sensor units 9, 10 with the reference elements 11, 12. Moreover, it is also possible here to arrange the sensors 9, 10 in such a way that their dimensions need not be taken into consideration when determining the operating width 26 of the paving screed 1.

Figure 7:
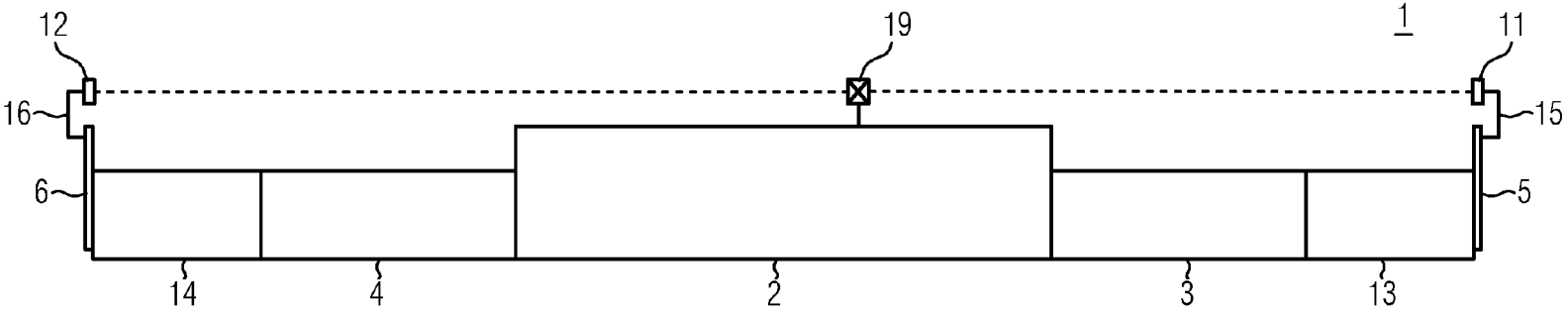
FIG. 7 shows a schematic top view of a paving screed according to a fourth embodiment of the disclosure.

FIG. 7 shows schematically a top view of the paving screed 1 according to a fourth embodiment. The configuration is essentially the same as that of the preceding embodiment. However, instead of the two sensor units 9, 10, only one single sensor unit 19 is provided. It is located along a straight line between the reference elements 11, 12 and measures both the distance to the first reference element 11 as well as the distance to the second reference element 12. Thus, these two measured distances need only be added together in order to obtain the operating width of the paving screed 1. The only correction is the addition of the width of the sensor unit 19. In processing the measured values, this corresponds to the addition of the measured widths a and b to the width of the base screed 2 from the first embodiment. Hence, existing systems could be retrofitted in a simple manner.

Figure 8:
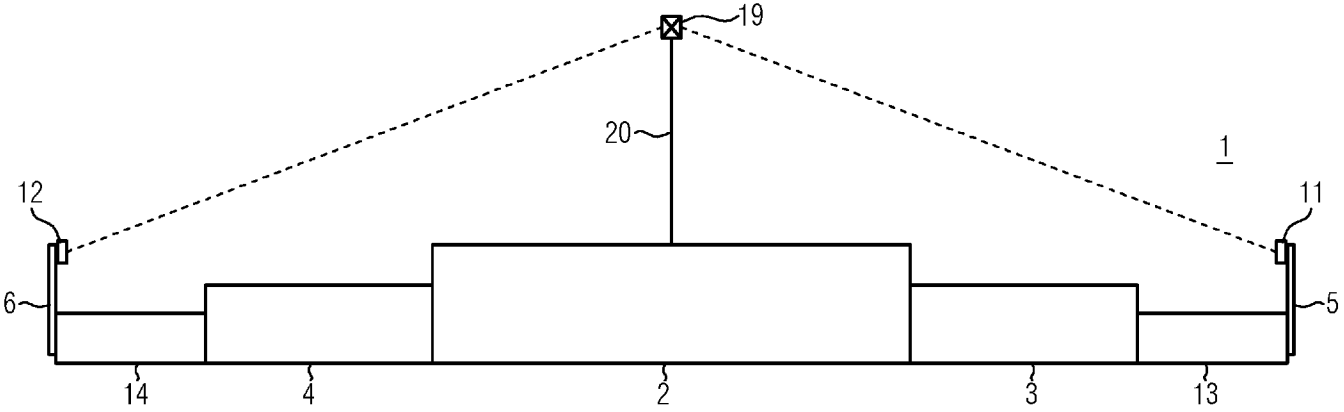
FIG. 8 shows a schematic rear view of a paving screed according to a fifth embodiment of the disclosure.

FIG. 8 shows schematically a rear view of the paving screed 1 according to a fifth embodiment of the disclosure. This embodiment also provides a single sensor unit 19. The, latter, however is not positioned along a straight line between the reference elements 11, 12 as in the previous embodiment, but rather is mounted on the base screed 2 with the aid of a holding unit 20. The holding unit 20 allows the sensor unit 19 to be positioned at an exposed location and thus to prevent a disruption of the signal path (represented by a dotted line) by objects positioned in the latter. This may be advantageous, particularly in systems that rely on direct visual contact such as, for example, optical methods or else acoustic methods. In this arrangement, the holding unit 20 and the sensor unit 19 mounted thereon may be provided on the paving screed 1 as well as on a road finisher 8 pulling the paving screed 1. Only one sensor unit 19 is provided in the embodiment shown in FIG. 8. Since this sensor unit is not located along a straight line between the reference elements 11, 12, the vertical distance between the sensor unit 19 and the reference elements 11, 12 and, if necessary, the horizontal distance in the direction perpendicular to the straight line between the reference elements 11, 12 must be known or set in order to calculate the operating width of the paving screed 1.

Figure 9:
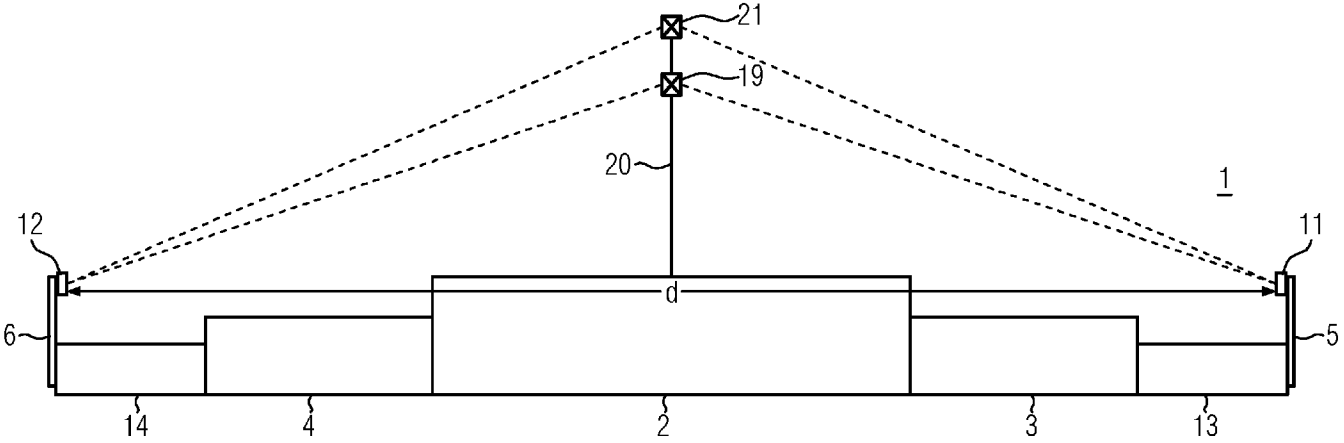
FIG. 9 shows a schematic rear view of a paving screed according to a sixth embodiment of the disclosure.

FIG. 9 shows schematically a rear view of the paving screed 1 according to a sixth embodiment. Here a second two-sided sensor unit 21 is provided. The vertical distance of these sensors 19, 21 to the reference elements 11, 12 need no longer be known in this embodiment. Instead, the operating width of the paving screed 1 may be determined by means of triangulation. In this arrangement, the sensor units 19, 21 may be implemented in a structural unit. They may also be mounted on the base screed 2 as well as at any arbitrary location on the road finisher 8 with the aid of the holding unit 20. The number of sensor units used for triangulation may also be greater than two. This makes it possible to determine more precisely the position of the reference elements 11, 12 and to also increase the robustness of the system to disruptive objects in the signal path.

Figure 10:
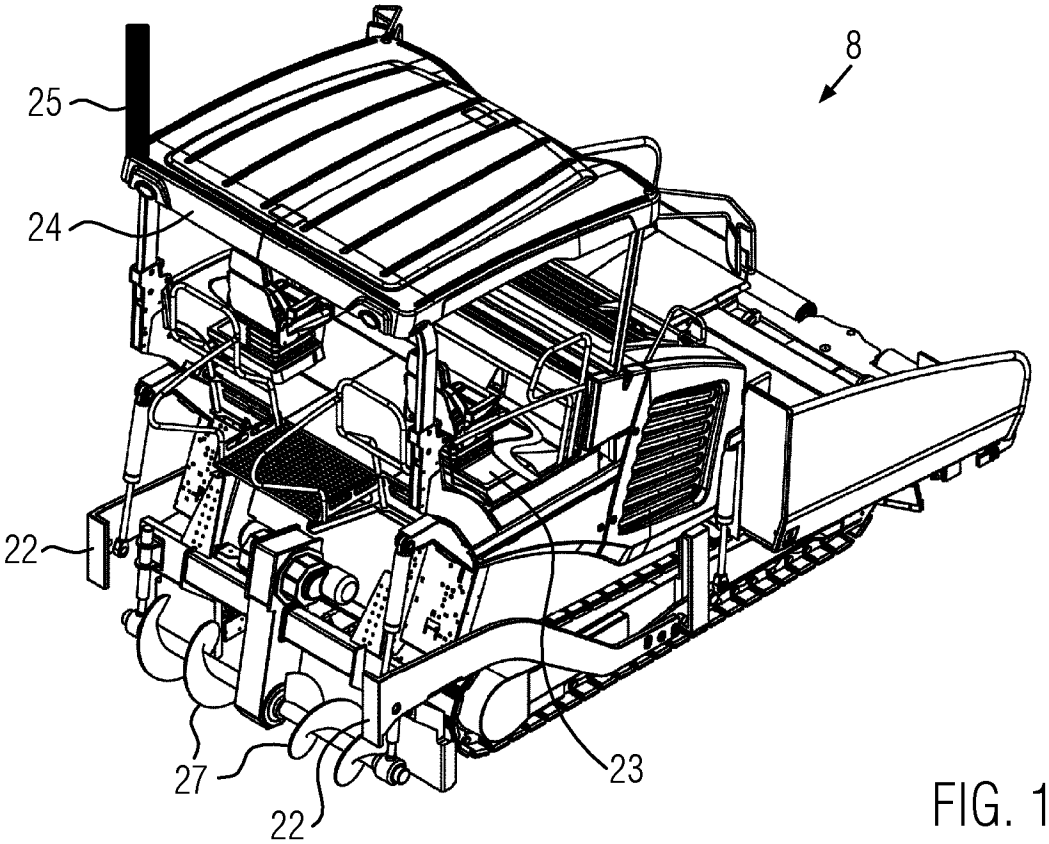
FIG. 10 shows a road finisher on which a paving screed according to the disclosure may be mounted.

FIG. 10 shows a perspective view of the road finisher 8. The road finisher includes mounting devices 22 which may be connected to the mounting devices 7 of the screed 1. The road finisher includes a control system 23. It can be used to control the operation of the road finisher, for example, the conveying speed of various conveyor systems. Shown in FIG. 10 are transverse augers 27 exemplary of all the conveyor devices of the road finisher. The control system 23 may use the operating width 26 determined with the aid of one of the above mentioned methods and devices as an input variable. It is also conceivable to affix one or several of the previously described sensor units 9, 10, 19, 21 or additionally provided sensor units on the road finisher 8, for example, on the roof structure thereof, or else to a mast 25 mounted on the road finisher 8.

As distance measuring methods it is possible in all embodiments to use laser, ultrasound or radar measurement methods, for example. Accordingly, various types of reference elements 11, 12 are conceivable, for example, different reflectors or transceiver units which receive a distance measurement signal and send it back, optionally supplemented with auxiliary information such as, for example, time stamp, position or identification information.

The embodiments described may represent merely a selection of possible combinations of the described features. The features described may be combined in any arbitrary manner, while also omitting individual features, in order to obtain additional advantageous embodiments of the disclosure.

While exemplary embodiments are described above, it is not intended that these embodiments describe all possible forms of the invention. Rather, the words used in the specification are words of description rather than limitation, and it is understood that various changes may be made without departing from the spirit and scope of the invention.

What is claimed is:

1. A paving screed to be employed on a road finisher, the paving screed comprising:

a base screed, an operating width of which may be modified by protractable extending units and/or separate removable bolt-on extensions;

a plurality of side plates each being mountable on an outer end of at least one of the base screed, an extending unit or a bolt-on extension and which delimit the operating width; and at least one reference element for determining the operating width provided on at least one of the side plates, such that the at least one reference element is positionable on a lateral portion of the paving screed, the at least one reference element being detectable by one or more sensor units when the side plates are each mounted on the outer end of at least one of the base screed, an extending unit or a bolt-on extension;

wherein a sensor unit of the one or more sensor units is provided on at least one of the side plates, the sensor unit being configured to measure a distance to the at least one reference element on another of the side plates.

2. The paving screed according to claim 1 wherein the one or more sensor units comprise multiple sensor units, and at least one of the sensor units is provided on the base screed and is configured to measure distances to the at least one reference element.

3. The paving screed according to claim 1 wherein the at least one reference element comprises multiple reference elements that are attached directly to the side plates.

4. The paving screed according to claim 1 wherein the at least one reference element comprises multiple reference elements that are indirectly attached to the side plates through adapters.

5. The paving screed according to claim 1 wherein the at least one reference element is aligned with an associated sensor unit of the one or more sensor units when the side plates are each mounted on the outer end of at least one of the base screed, an extending unit or a bolt-on extension.

6. A paving screed to be employed on a road finisher, the paving screed comprising:

a base screed, an operating width of which may be modified by protractable extending units and/or separate removable bolt-on extensions;

a plurality of side plates each being mountable on an outer end of at least one of the base screed, an extending unit or a bolt-on extension and which delimit the operating width; and at least one reference element for determining the operating width provided on at least one of the side plates, such that the at least one reference element is positionable on a lateral portion of the paving screed, the at least one reference element being detectable by one or more sensor units when the side plates are each mounted on the outer end of at least one of the base screed, an extending unit or a bolt-on extension;

wherein the one or more sensor units comprise multiple sensor units that are configured for determining the operating width by triangulation.

7. The paving screed according to claim 1 wherein one of the at least one reference element is positioned on an inner side of one of the side plates.

8. A road finisher comprising the paving screed according to claim 1.

9. The road finisher according to claim 8 further comprising a control system configured to utilize the determined operating width as an input variable.

10. The road finisher according to claim 8 wherein at least one of the one or more sensor units is provided on a portion of the road finisher.

11. A method for determining an operating width of a paving screed, which may be employed on a road finisher, wherein the paving screed comprises a base screed, an operating width of which may be modified by protractable extending units and/or separate removable bolt-on extensions, a plurality of side plates each being mountable on an outer end of at least one of the base screed, an extending unit or a bolt-on extension and which delimit the operating width of the paving screed, the method comprising:

determining the operating width of the paving screed using at least one reference element provided on at least one of the side plates, such that the at least one reference element is positioned on a lateral portion of the paving screed;

wherein the at least one reference element comprises multiple reference elements, and wherein the method is performed such that respective distances or a distance between the reference elements are/is measured by triangulation.

12. The method according to claim 11 wherein a distance to one of the reference elements, which one reference element is attached to a respective one of the side plates, is measured by at least one sensor unit associated with the respective side plate.

13. The method according to claim 11 wherein the multiple reference elements comprise a reference element attached to a first one of the side plates, and wherein a distance to the reference element attached to the first one of the side plates is measured by a sensor unit attached to a second one of the side plates.

14. The method according to claim 11 wherein, when the paving screed is employed on the road finisher, the road finisher comprises at least one sensor unit, and wherein determining the operating width of the paving screed comprises detecting at least one of the reference elements with the at least one sensor unit.

15. The method according to claim 14 wherein the at least one sensor unit comprises multiple sensor units that are each provided on a portion of the road finisher.

16. The method according to claim 15 wherein a first reference element of the multiple reference elements is provided on a first one of the side plates, and a second reference element of the multiple reference elements is provided on a second one of the side plates.

17. The method according to claim 11 wherein one of the reference elements is positioned on an inner side of one of the side plates.

18. A paving screed to be employed on a road finisher, the paving screed comprising:

a base screed, an operating width of which may be modified by protractable extending units and/or separate removable bolt-on extensions;

a plurality of side plates each being mountable on an outer end of at least one of the base screed, an extending unit or a bolt-on extension and which delimit the operating width; and at least one reference element for determining the operating width provided on at least one of the side plates, the at least one reference element being detectable by one or more sensor units, without direct contact with the one or more sensor units, when the side plates are each mounted on the outer end of at least one of the base screed, an extending unit or a bolt-on extension.

19. The paving screed according to claim 18 wherein each of the at least one reference element is positioned on a lateral portion of the paving screed when the side plates are each mounted on the outer end of at least one of the base screed, an extending unit or a bolt-on extension.

20. The paving screed according to claim 18 wherein a sensor unit of the one or more sensor units is provided on at least one of the side plates, the sensor unit being configured to measure a distance to the at least one reference element on another of the side plates.

21. The paving screed according to claim 18 wherein the at least one reference element comprises multiple reference elements for determining the operating width by triangulation.

* * * * *